US008413986B2

(12) United States Patent
Nakaishi

(10) Patent No.: US 8,413,986 B2
(45) Date of Patent: Apr. 9, 2013

(54) MEDIUM CARRYING MECHANISM AND IMAGE FORMING DEVICE

(75) Inventor: Yoshiaki Nakaishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 120 days.

(21) Appl. No.: 12/915,661

(22) Filed: Oct. 29, 2010

(65) Prior Publication Data

US 2011/0115148 A1 May 19, 2011

(30) Foreign Application Priority Data

Nov. 19, 2009 (JP) ..... 2009-264103

(51) Int. Cl.
*B65H 5/02* (2006.01)

(52) U.S. Cl.
USPC ..... 271/274; 271/188; 271/272

(58) Field of Classification Search ..... 271/188, 271/274, 272
See application file for complete search history.

(56) References Cited

U.S. PATENT DOCUMENTS

| | | | | |
|---|---|---|---|---|
| 2,713,932 | A * | 7/1955 | Letterman | 400/636.1 |
| 4,583,726 | A * | 4/1986 | Nogi et al. | 271/4.1 |
| 5,110,104 | A * | 5/1992 | Wakao et al. | 271/3.03 |
| 5,244,295 | A * | 9/1993 | Terashima et al. | 400/639 |
| 2008/0310900 | A1 * | 12/2008 | Lee | 399/406 |

FOREIGN PATENT DOCUMENTS

JP A-H07-237804 9/1995

* cited by examiner

*Primary Examiner* — Michael McCullough
*Assistant Examiner* — Howard Sanders
(74) *Attorney, Agent, or Firm* — Posz Law Group, PLC

(57) ABSTRACT

A medium carrying mechanism includes a carrying roller that carries a medium, two correction rollers for medium correction that face the carrying roller and that are positioned along a medium carrying direction, a bracket that includes a rotation shaft and that supports the correction rollers, a supporting member that supports the rotation shaft, and a bias member that biases the rotation shaft toward the carrying roller.

13 Claims, 6 Drawing Sheets

MEDIUM CARRYING MECHANISM AND IMAGE FORMING DEVICE

CROSS REFERENCE TO RELATED APPLICATION

The present application is related to, claims priority from and incorporates by reference Japanese patent application No. 2009-264103, filed on Nov. 19, 2009.

TECHNICAL FIELD

The present invention relates to medium carrying mechanisms provided by image forming devices and automatic manuscript carrying devices such as printers, photocopiers, facsimiles, and further relates to a method/system to prevent media from getting folded and getting a roller mark while media such as, especially, manuscripts and recording paper are carried.

BACKGROUND OF THE INVENTION

A conventional medium carrying mechanism provides two subsidiary rollers that are positioned along an outer circumference of one sheet ejection roller in order to correct curl of a sheet on which a toner is fused. The two subsidiary rollers are contacted and pressed to the sheet ejection roller by one leaf spring so that each of the subsidiary rollers press the sheet between the sheet ejection roller and each of the subsidiary rollers to the sheet ejection roller. As a result, the sheet is curved along the out circumference of the sheet ejection roller and the curl of the sheet is removed (for example, see Patent document; Japan Patent Laid-Open Publication No. H7-237804 (Paragraphs [0012] and [0019], and FIG. 2)).

However, with the above-described conventional art, a force applied by a leaf spring to press subsidiary rollers is eased when the sheet reaches a subsidiary roller on an upstream side, and a sheet is guided between a sheet ejection roller and the subsidiary rollers. During the process, depending on types of sheets being fed, there have been failures in carrying sheets. For example, a heavy sheet such as bond paper does not curve along the outer circumferential surface of the sheet ejection roller, and the subsidiary rollers are moved toward an opposite side of the sheet ejection roller due to the heaviness of the sheet. This decreases the ability to carry the sheet so that a carrying failure may occur; that is, the sheet ejection roller and each of the subsidiary rollers does not hold and carry the sheet properly. Similarly, when the elasticity of the leaf spring, which presses the sheet ejection roller, is increased to prevent such a carrying failure of the sheet, a heavy sheet such as bond paper is forced to curve along the outer circumferential surface of the sheet ejection roller. As a result, the sheet may receive damage such as being folded and/or marked by each of the subsidiary rollers. Considering the above failures, an object of the present invention is to provide a device that effectively carries a medium regardless of the types of the media.

SUMMARY OF THE INVENTION

According to solve the above difficulties, a medium carrying mechanism includes a carrying roller that carries a medium, two correction rollers for medium correction that face the carrying roller and that are positioned along a medium carrying direction, a bracket that includes a rotation shaft and that supports the correction rollers, a supporting member that supports the rotation shaft, and a bias member that biases the rotation shaft toward the carrying roller.

In another aspect of the invention, an image forming device of the present invention includes the medium carrying mechanism discussed above.

Therefore, the present invention provides an effect that the heavy sheet such as the bond paper certainly can be carried and a further effect that carrying failures such as damaging the sheet can be prevented.

DETAILED DESCRIPTION OF PREFERRED EMBODIMENTS

Figure 1:
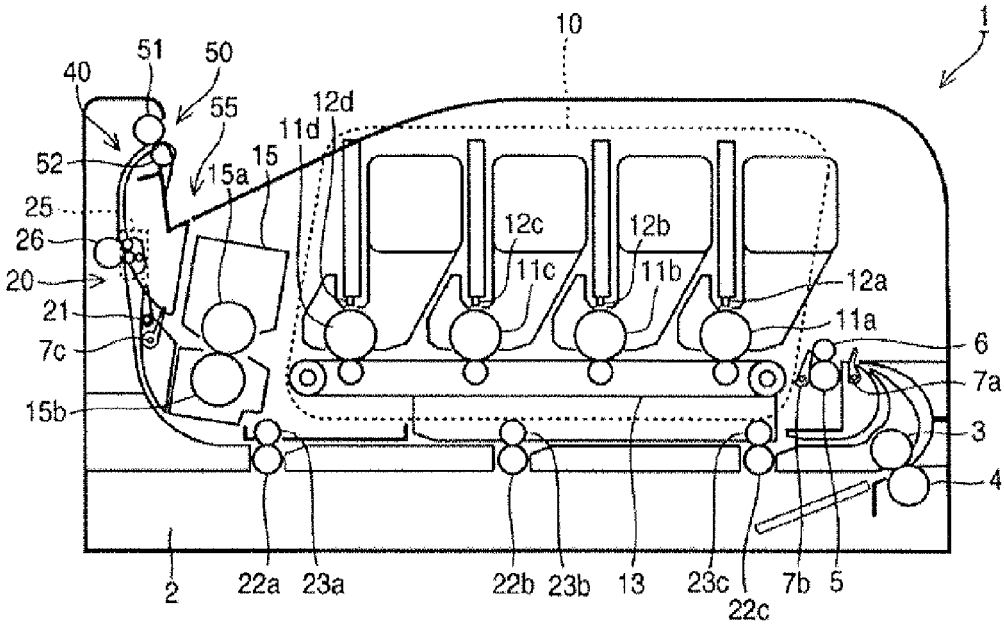
FIG. 1 illustrates a configuration of a printer providing a medium carrying mechanism of an embodiment 1.

Hereafter, embodiments of a medium carrying mechanism of the present invention will be explained referring to the drawings.

Embodiment 1

FIG. 1 illustrates a structure of a printer in which a medium carrying mechanism of an embodiment 1 is incorporated.

In FIG. 1, a printer 1 consists of a sheet feeding cassette 2, an image forming unit 10, a fusing unit 15, a sheet carrying part 20, a sheet ejection unit 40, and the like. The printer 1 carries a sheet fed from the sheets feeding cassette 2 to the image forming unit 10 and the fusing unit 15, and performs a printing process. Then, the printer 1 carries the printed sheet to the sheet ejection unit 40 with the sheet carrying part 20, and ejects the sheet to a sheet ejection tray 55 with the sheet ejection unit 40.

The sheet feeding cassette 2 is attached in a lower part of the printer 1. The sheet feeding cassette 2 includes a containing space for containing sheets used for printing, a feeding roller 3 for feeding the sheets from the containing space, and a separation roller 4, which is pressed and contacted to the feeding roller 3, for separating the sheets.

A skew correction roller 5 has a skew correction function and is positioned between the sheet feeding cassette 2 and the image forming unit 10. The skew correction roller 5 is pushed toward a correction shaft 6 by an elastic member (not shown).

When the sheet carried by the feeding roller 3 and the separation roller 4 makes contact between the skew correction roller 5 and the correction shaft 6, any skew is corrected.

The image forming unit 10 provides an image drum 11 a including a toner cartridge of color K (black), an image drum 11*b* including a toner cartridge of color Y (yellow), an image drum 11*c* including a toner cartridge of color M (magenta), an image drum 11*d* including a toner cartridge of color C (cyan), a LED head 12*a* of the color K, a LED head 12*b* of the color Y, a LED head 12*c* of the color M, a LED head 12*d* of the color C, and a transferring belt part 13. The image forming unit 10 adheres a toner image to the sheet.

The fusing unit 15 includes a fusing roller 15*a* and a back-up roller 15*b*. The fusing roller 15*a* includes a heat source such as a halogen lamp and contacts the print sheet from an upper side. The back-up roller 15*b* receives force from the fusing roller 15*a* and is driven with the fusing roller 15*a* to rotate. The heated fusing roller 15*a* and the back-up roller 15*b* hold the sheet between them. The heat of the fusing roller 15*a* melts the toner adhered to the sheet and the toner is fused on the sheet.

The sheet carrying part 20 is branched in two carrying directions: one carrying direction for carrying the printed sheet on which the toner is to be fused again toward the skew correction roller 5 and the correction shaft 6 for two-sided printing, and the other carrying direction for carrying the printed sheet to a sheet ejection unit 40, which will be described later. A separator 21 to which bias force from a bias member (not shown) is applied is driven to carry the sheet in each of the two carrying directions.

Sheet detecting sensors 7*a*, 7*b* and 7*c* detect the sheet being transferred. The sheet detecting sensor 7*a* is positioned between the sheet feeding cassette 2 and the skew correction roller 5 along the sheet feeding path. The sheet detecting sensor 7*b* is positioned between the skew correction roller 5 and the image forming unit 10. The sheet detecting sensor 7*c* is positioned in the vicinity of an exit of the fusing unit 15.

Inversion rollers 22*a*, 22*b* and 22*c* carry the sheet toward the skew correction roller 5 and the correction shift 6 to perform printing on the un-printed side of the sheet. The inversion rollers 22*a*, 22*b* and 22*c* are positioned under the image forming unit 10, and are rotationally driven by a driving source (not shown).

Driven rollers 23*a*, 23*b* and 23*c* are positioned to press and contact the inversion rollers 22*a*, 22*b* and 22*c*. Accordingly, the driven rollers 23*a*, 23*b* and 23*c* are driven by the rotation of the inversion rollers 22*a*, 22*b* and 22*c* to rotate.

The sheet, which is carried toward the skew correction roller 5 and the correction shaft 6 with the sheet carrying part 20, is held and carried between the inversion rollers 22*a*, 22*b* and 22*c* and the driven rollers 23*a*, 23*b* and 23*c* so that the sheet passes under the image forming unit 10. Then, the sheet enters between the skew correction roller 5 and the correction shaft 6 with a sheet guide positioned ahead.

Figure 3:
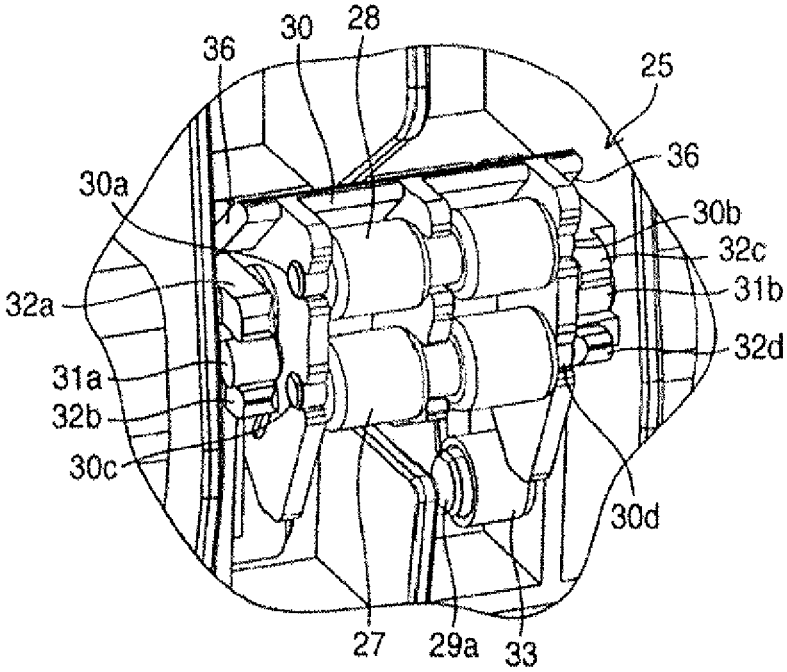
FIG. 3 is a perspective view illustrating a curl correction part.

A curl correction part 25 consists of a carrying roller 26, correction rollers 27 and 28, and the like. The correction rollers 27 and 28, which are for medium correction, contact the carrying roller 26 and are positioned at a predefined space at upstream and downstream locations along the sheet carrying direction. The curl correction part 25 corrects curling of the sheet passing between the carrying roller 26 and the correction rollers 27, 28. The details of the correction part are shown in FIG. 3, which is described further herein.

An ejection port 50 provides ejection rollers 51 and pinch rollers 52. The carried sheet is held by the ejection rollers 51 and the pinch rollers 52, and ejected on a sheet ejection tray 55.

Figure 2:
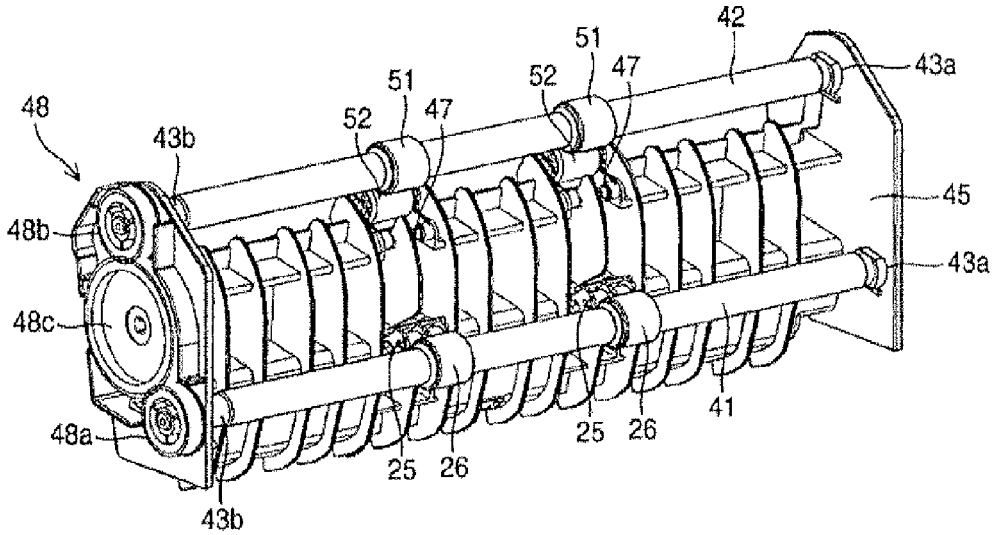
FIG. 2 illustrates a schematic configuration of a sheet ejection unit.

FIG. 2 illustrates a schematic configuration of a sheet ejection unit.

In FIG. 2, regarding shafts 41 and 42, one end of each of the shafts 41 and 42 is inserted to a frame 45 via a bearing 43*a* and the other end is inserted to a bearing 43*b*. As a result, the shafts 41 and 42 are rotationally supported. The carrying roller 26 is fixed to the shaft 41, and the ejection roller 51 is fixed to the shaft 42.

A torsion spring 47 is a pressing device to press the pinch roller 52 toward the ejection roller 51.

A gear train 48 consists of a driving gear 48*a* connected to the shaft 41, a driving gear 48*b* connected to the shaft 42 and a driven gear 48*c* engaging the driving gears 48*a* and 48*b*. When an unillustrated motor drives the driven gear 48*c*, the shafts 41 and 42 are rotated via the driving gears 48*a* and 48*b*.

Connecting parts between the driving gear 48*a* and the shaft 41 and between the driving gear 48*b* and the shaft 42 are formed in a D-cut shape.

Figure 4:
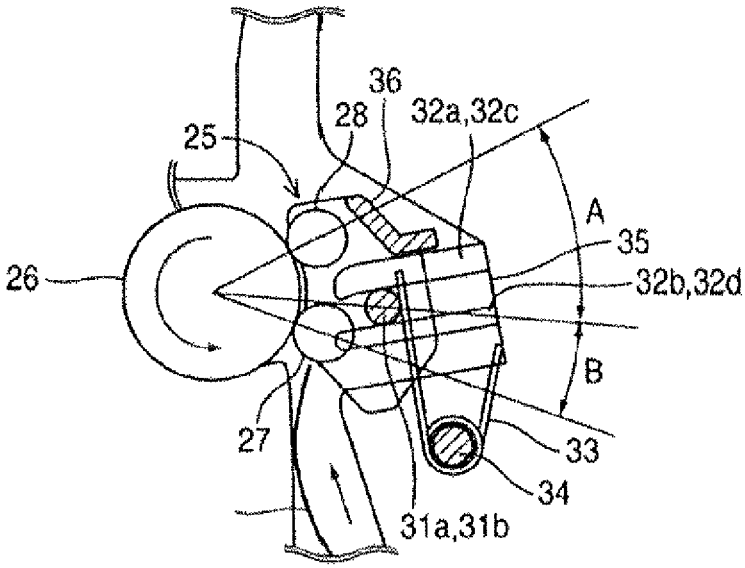
FIG. 4 is a side cross-sectional view illustrating the curl correction part.

FIG. 3 is a perspective view illustrating the curl correction part 25. FIG. 4 is a side cross-sectional view illustrating the curl correction part 25.

The view of FIG. 3 is taken from the side of the carrying roller 26. The carrying roller 26 is not illustrated in FIG. 3.

In FIG. 3, a bracket 30 supports the correction rollers 27 and 28. The bracket 30 forms supporting parts 30*a* and 30*b*, which rotationally support the correction roller 27 when both ends of a shaft part of the correction roller 27 are fitted in the supporting parts 30*a* and 30*b*, and supporting parts 30*c* and 30*d* rotationally support the correction roller 28 when both ends of a shaft part of the correction roller 28 are fitted in the supporting parts 30*c*, 30*d*.

The bracket 30 includes cylindrical projection parts 31*a* and 31*b* that are positioned at opposite ends in axial directions of the correction rollers 27 and 28. The cylindrical projection parts 31*a*, 31*b* protrude to the outside and function as a rotation shaft. The projection part 31*a* is fitted in a space between guide members 32*a*, 32*b*, which are a component of the frame illustrated in FIG. 4. The projection part 31*b* is fitted in a space between guide members 32*c* and 32*d*. The guide members 32*a*, 32*b*, 32*c* and 32*d* are supporting members that support the rotation shaft.

As illustrated in FIG. 4, setting a central axis of the carrying roller 26 as a reference point, a straight line extends toward a central axis of the correction roller 27, a line extends toward a central axis of the correction roller 28, and a line extends toward a central axis of the projection parts 31*a* and 31*b*.

Among the three straight lines shown in FIG. 4, an angle formed by the straight line extending toward the central axis of the correction roller 28 and the straight line extending to the central axis of the projection parts 31*a* and 31*b* is referred to as an angle A (or first angle), and an angle formed by the straight line extending toward the central axis of the correction roller 27 and the straight line extending to the central axis of the projection parts 31*a* and 31*b* is referred to as an angle B (or second angle). Then, the projection parts 31*a* and 31*b* are arranged at a position satisfying a condition A>B>0 (in the present embodiment, A:B=2:1), in other words, at a position where is more close to the correction roller 27 at the upstream in the carrying direction in which the sheet is curried to the sheet ejection unit 40 than the correction roller 28 at the downstream of the carrying direction.

Each of the above-described guide members 32*a*, 32*b*, 32*c* and 32*d* is formed such that surfaces that face the cylindrical projection parts 31*a*, 31*b* are inclined downward as illustrated in FIG. 4.

As a result, the curl correction part 25 is designed to slide toward the carrying roller 26 due to the weight of the curl correction part along the incline of the guide members 32*a*, 32*b*, 32*c* and 32*d*. Thus, the curl correction part 25 is held at a position where both of the correction rollers 27 and 28 contact the carrying roller 26.

A spring part 33 is an elastic member (or a bias member) such as a torsion spring to press the projection parts 31*a* and 31*b* of the bracket 30 toward the carrying roller 26. Although not illustrated in FIG. 3 because it is hidden on an opposite side of the frame, the spring part 33 is configured such that a tip part presses the projection part 31*a* and the projection part 31*b* by, for example, being shaped in Y-shape when viewed in the side cross-sectional view of FIG. 4.

The spring part 33 is firmly attached with a post 34 of the frame and a placing surface 35.

Pivot regulation parts 36 (or rregulation parts) are one component of the bracket 30. The pivot regulation parts 36 are positioned at two positions. One is above the guide member 32*a* keeping a predefined space from the guide member 32*a*. The other is above the guide member 32*c* keeping a predefined space from the guide member 32*c*.

Functions of the above-described configuration will be explained.

Initially, print processes of the printer 1 will be explained.

A sheet from the sheet feeding cassette 2 is separated and fed by the feeding roller 3 and the separation roller 4. Then, any skew of the sheet is corrected when the sheet makes contact between the skew correction roller 5 and the correction shaft 6. Then, the sheet is fed to the image forming unit 10.

The image forming unit 10 transfers a toner image on one side of the sheet, and the sheet is carried to the fusing unit 15 where the toner image is fused on the sheet.

In the case of one-side printing, the sheet on which the toner image is fused is carried to the curl correction part 25 and the sheet ejection unit 40 by the sheet carrying part 20.

On the other hand, in the case of two-sided printing, the sheet is carried to the curl correction part 25 with the sheet carrying part 20. After that, a trailing edge of the sheet passes between the carrying roller 26 and the curl correction part 25, by the carrying direction regulated by the sheet carrying part 20 is reversed, the sheet passes between the carrying roller 26 and the curl correction part 25, and is carried to the inversion rollers 22*a*, 22*b* and 22*c* and the driven rollers 23*a*, 23*b* and 23*c*.

The inversion rollers 22*a*, 22*b* and 22*c* and the driven rollers 23*a*, 23*b* and 23*c* hold and carry the sheet to the skew correction roller 5 and the correction shaft 6.

At that time, an unprinted surface of the sheet faces upward. When the sheet is carried to the image forming unit 10 as it is, a toner image is formed on the unprinted surface. The sheet is carried to the fusing unit 15, the toner image is fused on the sheet, two-sided printing is executed, and the sheet is carried to the curl correction part 25.

The sheet carried to the curl correction part 25 is carried to the sheet ejection unit 40 ahead, being corrected a curl thereof. The sheet is ejected on the sheet ejection tray 55 from the ejection port 50.

A curl correction process of the sheet by the curl correction part 25 will be explained below.

Figure 5:
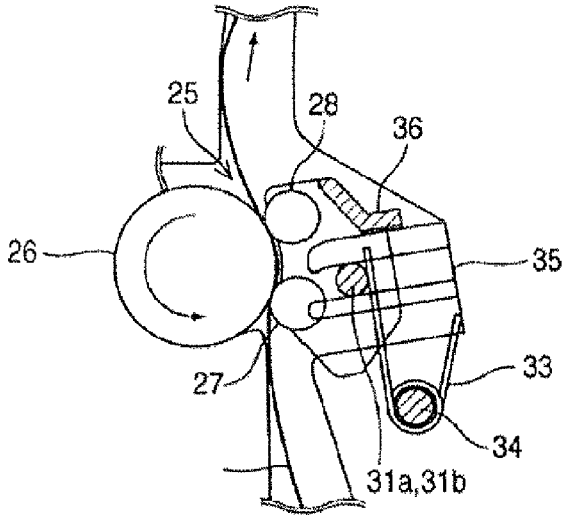
FIG. 5 is an explanatory view illustrating a movement of which a plain sheet passes through the curl correction part.
Figure 6A:
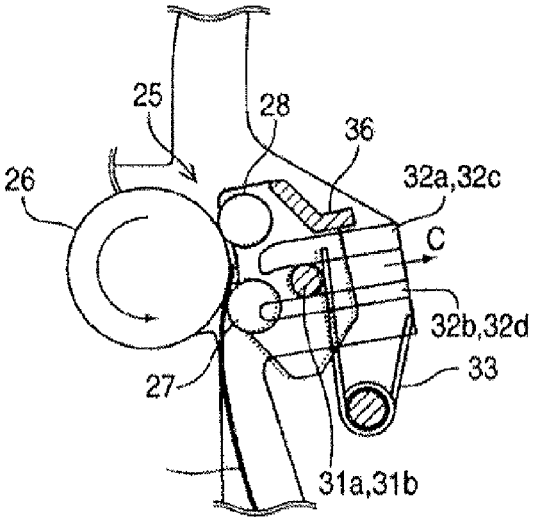
FIGS. 6A and 6B are explanatory views illustrating a movement of which a bond sheet enters into the curl correction part.
Figure 6B:
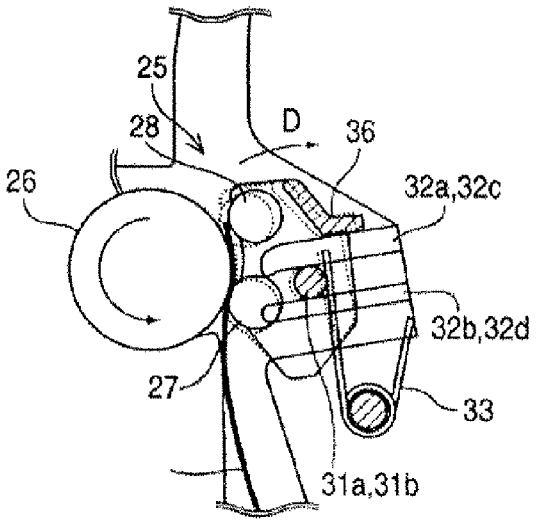
Figure 7:
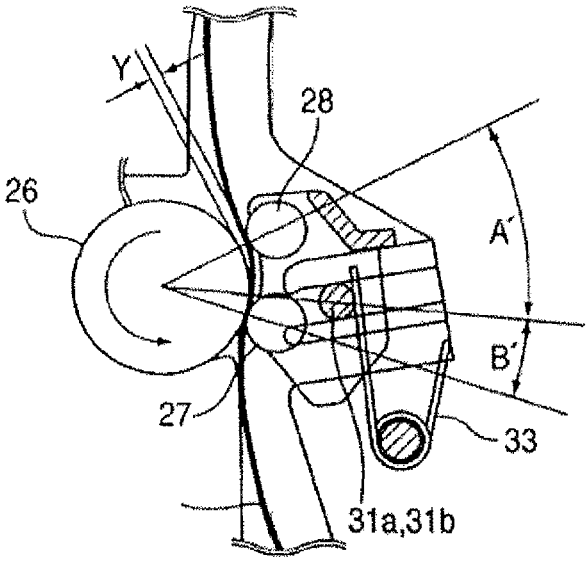
FIG. 7 is an explanatory view illustrating a movement of which the bond sheet passes through the curl correction part.

FIG. 5 is an explanatory view illustrating movement of a plain sheet through the curl correction part. FIGS. 6A and 6B are explanatory views illustrating movement of a bond sheet into the curl correction part 25. FIG. 6A illustrates a movement of a leading edge of a sheet to the correction roller 27 from an upstream direction. FIG. 6B illustrates a movement in which the leading edge of the sheet engages the correction roller 28 from a downstream side of the correction roller 28. FIG. 7 is an explanatory view of which a relatively heavy bond paper passes through the curl correction part 25.

The curl correction process changes depending on the thickness of the sheet. Respective processes for carrying a plain sheet or a bond sheet will he explained.

In the case of a plain sheet, as illustrated in FIG. 5, the plain sheet is held by the carrying roller 26 and the correction rollers 27 and 28 that press and contact the carrying roller 26 and is carried along an outer circumferential surface of the carrying roller 26. At that time, a part of the sheet held by the carrying roller 26 and the correction rollers 27 and 28 is curved along the outer circumferential surface of the carrying roller 26. As a result, a curl of the sheet is corrected.

On the other hand, in the case of a bond sheet, when a leading edge of the sheet reaches the correction roller 27 on an upstream side of the correction part 25, the correction roller 27 is pushed away from the carrying roller 26 by the thickness and weight of the sheet, which is relatively thick and relatively heavy compared to the plain sheet discussed above in connection with FIG. 5. The correction roller 28 moves along the outer circumferential surface of the carrying roller 26, and the curl correction part 25 pivots to separate the correction roller 27 from the carrying roller 26. As a result, the projection parts 31*a* and 31*b* move in the direction of an arrow C of FIG. 6A.

At this time, by the movement of the projection parts 31*a* and 31*b* in the direction of the arrow C, a deflection amount (or deformed angle) of the spring part 33 is increased, which causes the force of the correction roller 28 against the carrying roller 26 to increase.

When the paper being carried engages the correction roller 28, as illustrated in FIG. 6B, the curl correction part 25 pivots in a direction of an arrow D due to the thickness and weight of the sheet. However, as described above, since a pivot regulation part 36 is formed above the guide members 32*a* and 32*c*, the pivot regulation part 36 contacts the guide members 32*a* and 32*c* and the pivoting of the curl correction part 25 is regulated.

As illustrated in FIG. 7, the pivoting curl correction part 25 is positioned such that the correction roller 28 is firmly attached by a predetermined distance Y from the carrying roller 26. As a result, the force applied by the spring part 33 to the bracket 30 acts at an incline toward the correction roller 27, the sheet is pressed toward the carrying roller 26, and the sheet is held and carried by the correction roller 27 and the carrying roller 26 under these circumstances.

Additionally, the distance Y at this time is defined depending on the size of the space between the guide members 32*a* and 32*c* and the pivot regulation part 36. The size of the space between the guide members 32*a* and 32*c* and the pivot regulation part 36 is defined so that the distance Y becomes similar to the maximum sheet thickness of the sheets to be carried.

As illustrated in FIG. 7, setting a central axis of the carrying roller 26 as a reference point, an angle formed by a straight line extending to the central axis of the correction roller 28 and a straight line extending to the central axis of the projection parts 31*a* and 31*b* is defined as an angle A' (or first angle), and an angle formed by a straight line extending to the central axis of the correction roller 27 and a straight line extending to the central axis of the projection parts 31*a* and 31*b* is defined as an angle B' (second angle). When the curl correction part 25 pivots due to the conveyance of a relatively heavy and thick sheet, such as bond, as described above, the angle A' stays almost the same as the angle A illustrated in FIG. 4, on the other hand, the angle B becomes smaller than the angle B' illustrated in FIG. 4. Therefore, the force from the correction roller 28 to the carrying roller 26 increases. As a result, the conveyance of the sheet will be stable and reliable.

As described above, in the present embodiment, the projection parts 31*a*, 31*b*, which are the rotation shafts of the curl correction part 25, are positioned close to the correction roller 27 on an upstream side of the curl correction part 25. When the downstream correction roller 28 is pressed away from the carrying roller 26 by a heavy sheet such as a bond sheet, the downstream correction roller 28 moves away from the carrying roller 26, and the curl correction part 25 positively pivots such that the upstream correction roller 27 on the upstream side presses the sheet against the carrying roller 26. As a result, since the upstream correction roller 27 and the carrying roller 26 can hold the sheet, the carrying force of the sheet can be positively maintained. Attaching an elastic member such as a leaf spring to the correction roller prevents the sheet from being damaged. Such damage may be, for example, impressions or tracings of the rollers on the sheet due to strong pressure when the correction roller 27 is pressed against the carrying roller 26.

The projection parts of the bracket 30 are attached close to the upstream correction roller 27. As a result, a greater external force is required to rotate the bracket 30 when the upstream correction roller 27 is moved away from the carrying roller 26 than when the downstream correction roller 28 is moved in a direction away from the carrying roller 26. Therefore, the upstream correction roller 27 is configured to barely separate from the carrying roller 26, so that stable carrying of the sheet by the carrying roller 26 and the upstream correction roller 27 is achieved.

The projection parts 31*a*, 31*b*of the bracket 30 are attached relatively close to the upstream correction roller 27. That is, the projection parts 31*a*, 31*b* are closer to the upstream correction roller 27 than to the downstream correction roller 28. As the result, when the bracket 30 pivots around the projection parts 31*a*, 31*b* due to the heaviness and thickness of the sheet, it is relatively easy for the sheet to move the downstream correction roller 28 away from the carrying roller 26. Similarly, the upstream correction roller 27 presses more strongly toward the carrying roller 26, so that the holding and carrying of the sheet by the upstream correction roller 27 and the carrying roller 26 are more stable.

Furthermore, since the spring part presses the projection parts 31*a*, 31*b*, the upstream correction roller 27 is configured to barely separate from the carrying roller 26. As the result, the carrying of the sheet by the upstream carrying roller 27 and the correction roller 26 is executed in a stable manner.

Regarding the load from the spring part 33 directed to the pivoting bracket 30, in contrast to, for example, when the spring part 33 presses something other than the projection parts 31*a*, 31*b*, the load from the spring part 33 that discourages the bracket 30 from pivoting is small when the spring pad presses the projection parts 31*a*, 31*b*. As a result, the spring part 33 is not an obstacle to pivoting the bracket 30.

Embodiment 2

Figure 8:
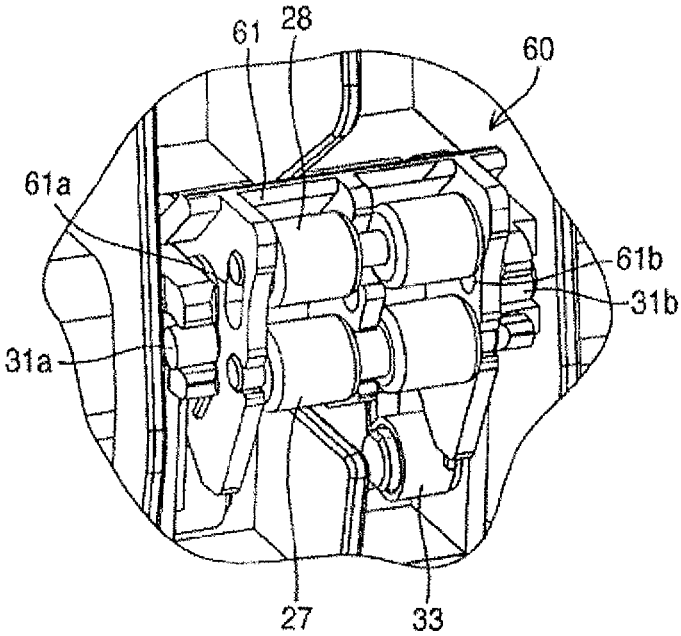
FIG. 8 is a perspective view illustrating a curl correction part of an embodiment 2.

FIG. 8 is a perspective view illustrating a curl correction part of a second embodiment.

Descriptions of parts that are the same part as parts in the above-described first embodiment are omitted, and the same reference numbers for corresponding parts.

In FIG. 8, a correction part 60 of the second embodiment is configured with the correction rollers 27 and 28, the spring part 33, a bracket 61, and the like.

Compared with the bracket 30 of the first embodiment, the bracket 61 includes elongated holes 61*a* and 61*b*, which are elongated in an up-down direction along the carrying direction instead of the supporting parts 30*c* and 30*d* supporting the downstream correction roller 28. Both ends of the shaft part of the correction roller 28 are inserted into the elongated holes 61*a* and 61*b*, as shown.

The correction roller 28 can move in the up-down direction within the range of the elongated holes 61*a* and 61*b*.

The size of the elongated holes 61*a* and 61*b* is determined as follows: When the correction roller 28 is at the highest position, the size is determined so that the correction roller 28 has the same position as that of the correction roller 28 in the first embodiment. When the correction roller 28 is at the lowest position, the size is determined such that the correction roller 28 is positioned to be symmetrical with the correction roller 27 with respect to a line running through the central axis of the carrying roller 26 and the central axis of the projection parts 31*a* and 31*b*.

Regarding functions of the above-described configuration, especially a sheet carried to the curl correction part 60 will be described.

Figure 9:
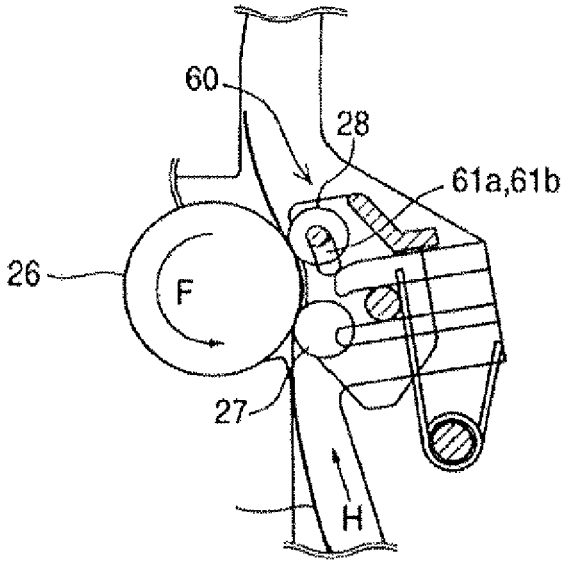
FIG. 9 is an explanatory view illustrating a movement of which the plain sheet is carried between the curl correction part and a carrying roller.
Figure 10:
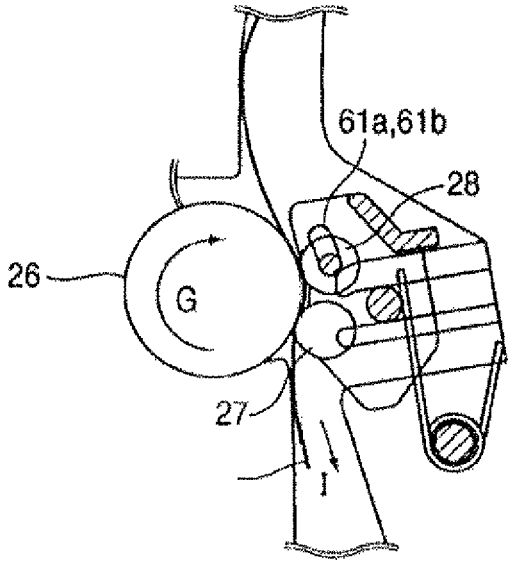
FIG. 10 is an explanatory view illustrating the curl correction part and the carrying roller that carry the plain sheet for two-sided print.

FIG. 9 is an explanatory view illustrating a movement in which a plain sheet is carried between the curl correction part 60 and a carrying roller 26. FIG. 10 is an explanatory view illustrating the curl correction part 60 and the carrying roller 26, during two-sided printing of a plain sheet.

For carrying a sheet, which is a plain sheet carried from the fusing unit 15, toward the sheet ejection unit 40, which is a direction of an arrow H of FIG. 9, the carrying roller 26 is rotated in a direction of an arrow F. At that time, the carrying roller 26 and the correction rollers 27 and 28 of the curl correction part 25 hold and carry the sheet. Then, the correction roller 28 rotates corresponding to the rotation of the carrying roller 26, and the shaft parts moves upward to contact the upper limit part of the elongated holes 61*a* and 61*b*.

For two-sided printing, the carrying roller 26 is rotated in a direction of an arrow G to reverse the carrying direction of the sheet and to carry the sheet in a direction of arrow I of FIG. 10. At that time, the plain sheet is held and carried by the carrying roller 26 and the correction rollers 27 and 28. Simultaneously, the correction roller 28 rotates corresponding to the rotation of the carrying roller 26, and the shaft parts of the correction roller 28 move downward to contact the lower limit part of the elongated holes 61*a* and 61*b*.

Next, the case of carrying a bond sheet will be explained.

Figure 11:
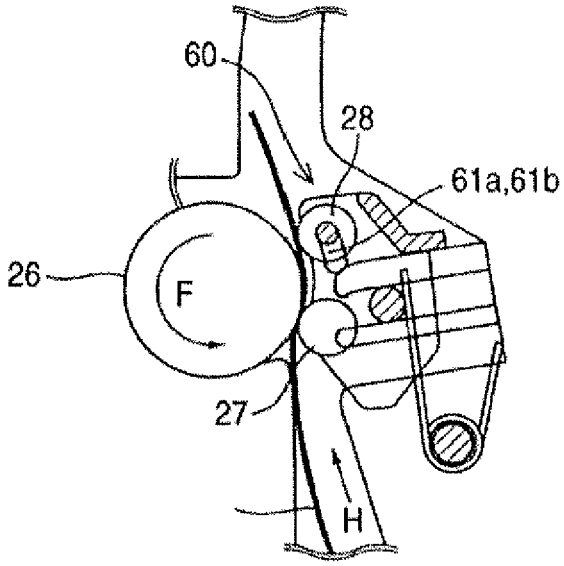
FIG. 11 is an explanatory view illustrating a movement of which the bond sheet is carried between the curl correction part and the carrying roller.
Figure 12:
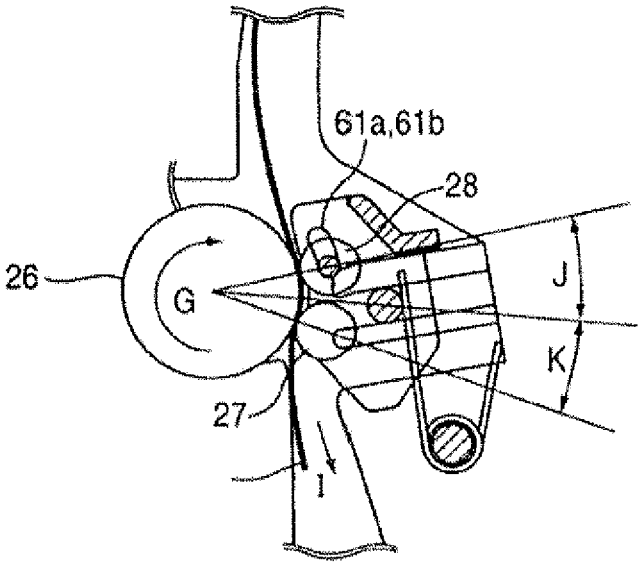
FIG. 12 is an explanatory view illustrating the curl correction part and the carrying roller that carry the bond sheet for two-sided print.

FIG. 11 is an explanatory view illustrating a movement in which a bond sheet is carried between the curl correction part 60 and the carrying roller 26. FIG. 12 is an explanatory view illustrating the curl correction part 60 and the carrying roller 26 that carry a sheet of bond during two-sided printing.

For carrying the sheet of bond from the fusing unit 15 toward the sheet ejection unit 40, that is, in the direction of the arrow H of FIG. 11, the carrying roller 26 is rotated in the direction of an arrow F. When the leading edge of the carried sheet engages the correction roller 28, the correction roller 28 separates from the carrying roller 26 and the curl correction part 60 pivots such that the correction roller 27 is positioned to hold the sheet with the carrying roller 26.

At that time, the pivoting direction is the clockwise direction of FIG. 11. As in the first embodiment, the curl correction part 60 is sustained in a position where the pivot regulation part 36 contacts the guide members 32*a* and 32*c*.

At that time, the correction roller 28 and the carried sheet move upward to a position where the shaft part of the correction roller 28 contacts the upper limits of the elongated holes 61*a* and 61*b*.

Then, when the carrying roller 26 is rotated in the direction of an arrow G for two-sided printing in order to reverse the carrying direction of the sheet and to carry the sheet in a direction of an arrow 1 of FIG. 12, the correction roller 28 and the carried sheet move downward to a position where the shaft parts contact the lower limits of the elongated holes 61*a* and 61*b*.

As illustrated in FIG. 12, when the correction roller 28 moves downward, the distance between the correction rollers 27 and 28 decreases. Also, an angle K formed by a straight line extending from the central axis of the carrying roller 26 to the central axis of the correction roller 27 and a straight line extending from the central axis of the carrying roller 26 to the central axis of the projection parts 31*a* and 31*b*, and an angle J formed by a straight line extending from the central axis of the carrying roller 26 to the central axis of the correction roller 28 and a straight line extending from the central axis of the carrying roller 26 to the central axis of the projection parts 31*a* and 31*b* are almost the same.

Therefore, the correction roller 28 is positioned to press the surface of the carrying roller 26. Accordingly, of the force against the carrying roller 26 from the correction rollers 27 and 28, becomes almost uniform, and the sheet is held and carried by the carrying roller 26 and the correction rollers 27 and 28.

As described above, in the second embodiment, further to the effect of the first embodiment described above, the downstream correction roller 28 can be positioned close to the other correction roller 27. Similarly, the two correction rollers 27, 28 can be almost asymmetry positioned with respect to the position of the carrying roller. As the result, a carrying direction to carry to the ejection port is reversed, so that a stable carry of the carried paper is achieved.

Additionally, in each of the above-described embodiments, sheets are used as recording media. However, the recording media can be any media that has sheet shape and on which an image can be formed with a printing head. The recording media can also be materials that are extremely thin with respect to a printing surface such as an OHP sheet, a label, a cloth, and the like.

What is claimed is:

1. A medium carrying mechanism, comprising:

a carrying roller that carries a medium;

two correction rollers for medium correction that face the carrying roller and that are positioned along a medium carrying direction;

a bracket that includes a rotation shaft and that supports the correction rollers;

a supporting member that supports the rotation shaft and that includes guide members that are inclined toward the carrying roller, the rotation shaft being provided between the guide members to enable the rotation shaft to slide between the guide members toward and away from the carrying roller; and a bias member that biases the rotation shaft toward the carrying roller, wherein the rotation shaft is located closer to an upstream one of the correction rollers than a downstream one of the correction rollers.

2. The medium carrying mechanism according to claim 1, wherein an edge part of the guide members is inclined toward an upstream one of the correction rollers with respect to a straight line connecting central axes of the carrying roller and the rotation shaft.

3. The medium carrying mechanism according to claim 1, wherein the bracket includes a supporting part that rotationally supports the correction rollers.

4. The medium carrying mechanism according to claim 1, further comprising:

a regulation part that regulates pivotal movement of the bracket about the rotation shaft.

5. The medium carrying mechanism according to claim 1, wherein the medium carrying mechanism is part of an image forming device.

6. An image forming device, comprising the medium carrying mechanism according to claim 1.

7. A medium carrying mechanism, comprising:

a carrying roller that carries a sheet;

two correction rollers for correcting curling of the sheet, wherein the two correction rollers face the carrying roller and are spaced apart in a sheet carrying direction, and wherein the two correction rollers include an upstream correction roller and a downstream correction roller;

a bracket that supports the correction rollers, wherein the bracket includes a rotation shaft, which is parallel to an axis of the carrying roller and axes of the correction rollers;

a supporting member that supports the rotation shaft, so that the bracket is pivotal about an axis of the rotation shaft, and that includes guide members that are inclined toward the carrying roller, the rotation shaft being provided between the guide members to enable the rotation shaft to slide between the guide members toward and away from the carrying roller; and a bias member that urges the rotation shaft toward the carrying roller.

8. The medium carrying mechanism according to claim 7, wherein the rotation shaft is located closer to the upstream correction roller than the downstream correction roller.

9. The medium carrying mechanism according to claim 7, wherein a second angle is smaller than a first angle, where the second angle is defined by a straight line connecting central axes of the rotation shaft and the carrying roller and a straight line connecting central axes of an upstream one of the correction rollers and the carrying roller, and the first angle is defined by the straight line connecting the central axes of the rotation shaft and the carrying roller and a straight line connecting central axes of a downstream one of the correction rollers and the carrying roller.

10. The medium carrying mechanism according to claim 7, wherein a surface of the supporting member that engages and supports the rotation shaft is inclined in a downward direction toward the upstream correction roller.

11. A medium carrying mechanism, comprising:

a carrying roller that carries a medium;

two correction rollers for medium correction that face the carrying roller and that are positioned along a medium carrying direction;

a bracket that includes a rotation shaft and that supports the correction rollers;

a supporting member that supports the rotation shaft and that includes guide members that are inclined toward the carrying roller, the rotation shaft being provided between the guide members to enable the rotation shaft to slide between the guide members toward and away from the carrying roller; and a bias member that biases the rotation shaft toward the carrying roller, wherein a second angle is smaller than a first angle, where the second angle is defined by a straight line connecting central axes of the rotation shaft and the carrying roller and a straight line connecting central axes of an upstream one of the correction rollers and the carrying roller, and the first angle is defined by the straight line connecting the central axes of the rotation shaft and the carrying roller and a straight line connecting central axes of a downstream one of the correction rollers and the carrying roller.

12. A medium carrying mechanism, comprising:

a carrying roller that carries a medium;

two correction rollers for medium correction that face the carrying roller and that are positioned along a medium carrying direction;

a bracket that includes a rotation shaft and a supporting part that rotationally supports the correction rollers and that supports the correction rollers;

a supporting member that supports the rotation shaft and that includes guide members that are inclined toward the carrying roller, the rotation shaft being provided between the guide members to enable the rotation shaft to slide between the guide members toward and away from the carrying roller; and a bias member that biases the rotation shaft toward the carrying roller, wherein the supporting part supports a downstream one of the correction rollers and is an elongated hole.

13. The medium carrying mechanism according to claim 12, wherein the elongated hole is elongated generally in the medium carrying direction.

* * * * *